US010323382B2

(12) United States Patent
Sharp

(10) Patent No.: US 10,323,382 B2
(45) Date of Patent: Jun. 18, 2019

(54) BLADE LEVELLING APPARATUS AND MOUNTING SYSTEM

(71) Applicants: PROGRESSIVE IP LIMITED, Hamilton (NZ); Rodney Warwick Sharp, Hamilton (NZ)

(72) Inventor: Rodney Warwick Sharp, Ngaruawahia (NZ)

(73) Assignee: PROGRESSIVE IP LIMITED, Hamilton (NZ)

( * ) Notice: Subject to any disclaimer, the term of this patent is extended or adjusted under 35 U.S.C. 154(b) by 0 days.

(21) Appl. No.: 15/317,457

(22) PCT Filed: Jun. 10, 2015

(86) PCT No.: PCT/NZ2015/050071

§ 371 (c)(1),
(2) Date: Dec. 9, 2016

(87) PCT Pub. No.: WO2015/190937

PCT Pub. Date: Dec. 17, 2015

(65) Prior Publication Data

US 2017/0130421 A1 May 11, 2017

(30) Foreign Application Priority Data

Jun. 10, 2014 (NZ) ..... 626006
Sep. 23, 2014 (NZ) ..... 700307

(51) Int. Cl.
*E02F 3/815* (2006.01)
*E02F 3/76* (2006.01)
(Continued)

(52) U.S. Cl.
CPC ..... *E02F 3/815* (2013.01); *E02F 3/7631* (2013.01); *E02F 3/7672* (2013.01);
(Continued)

(58) Field of Classification Search
CPC ..... E02F 3/7609; E02F 3/7618; E02F 3/7631; E02F 3/815
(Continued)

(56) References Cited

U.S. PATENT DOCUMENTS 2,718,719 A 9/1955 Anderson
2,816,375 A 12/1957 Anderson
(Continued)

OTHER PUBLICATIONS

International Search Report, PCT/NZ2015/050071, dated Sep. 9, 2015.

*Primary Examiner* — Gary S Hartmann
(74) *Attorney, Agent, or Firm* — Young & Thompson

(57) ABSTRACT

A levelling apparatus, typically as used on tractors, excavators and skid-steer vehicles, and references the levelling assembly and mounting options including directly to the existing blade of vehicles as well as other mounting arrangements is provided. Preferred embodiments of a levelling apparatus include a blade body portion and body mounting portion connected by an arrangement of fixed and adjustable linkages, preferably hydraulic, to allow movement of the blade body portion (relative to the body mounting portion) in substantially an up and down direction, as well as rotational movement about an axis perpendicular to the general plane of an attached blade.

14 Claims, 7 Drawing Sheets

(51) Int. Cl.
*E02F 3/84* (2006.01)
*E02F 3/96* (2006.01)

(52) U.S. Cl.
CPC ..... *E02F 3/7677* (2013.01); *E02F 3/844* (2013.01); *E02F 3/847* (2013.01); *E02F 3/961* (2013.01); *E02F 3/962* (2013.01); *E02F 3/963* (2013.01)

(58) Field of Classification Search
USPC ..... 172/811, 824, 825, 834
See application file for complete search history.

(56) References Cited

U.S. PATENT DOCUMENTS 3,049,820 A * 8/1962 Lichti ..... E02F 3/7618 172/826
3,452,828 A * 7/1969 Deli ..... E02F 3/7613 172/826
3,631,931 A * 1/1972 Frisbee ..... E02F 3/7613 172/484
3,661,214 A 5/1972 Peterson et al.
3,698,490 A * 10/1972 King ..... E02F 3/7618 172/824
3,793,752 A * 2/1974 Snyder ..... E01H 5/063 172/413
3,901,329 A 8/1975 Eftefield
3,941,195 A 3/1976 Stedman
3,998,277 A * 12/1976 Wirt ..... E02F 3/7618 172/826
4,026,368 A 5/1977 Asal
4,106,795 A * 8/1978 Henning ..... A01B 59/048 172/834
4,135,584 A 1/1979 Smith et al.
4,147,218 A * 4/1979 Stedman ..... B62D 49/04 172/825
4,185,698 A * 1/1980 Frisbee ..... E02F 3/7618 172/33
4,201,268 A * 5/1980 Frisbee ..... E02F 3/7613 172/812
4,253,529 A 3/1981 Nissen
4,270,617 A * 6/1981 Cantarella ..... E02F 3/7613 172/701.1
4,405,019 A 9/1983 Frisbee
4,893,683 A * 1/1990 Horsch ..... E02F 3/80 172/821
6,105,682 A * 8/2000 Recker ..... E02F 3/7618 172/811
6,273,198 B1 * 8/2001 Bauer ..... E02F 3/7613 172/825
6,688,403 B2 * 2/2004 Bernhardt ..... A01B 69/004 172/2
6,827,155 B1 * 12/2004 Hoffart ..... A01B 59/044 172/821
7,008,168 B2 * 3/2006 Bernhardt ..... A01B 63/1006 172/272
7,131,502 B1 * 11/2006 Hoffart ..... A01B 59/044 172/821
8,118,111 B2 * 2/2012 Armas ..... E02F 3/3414 172/779
2008/0210446 A1 * 9/2008 Cherney ..... E02F 3/7618 172/824
2012/0279735 A1 * 11/2012 Ditzler ..... E02F 3/815 172/825
2016/0108603 A1 * 4/2016 Hoyt ..... E02F 3/7613 172/663

* cited by examiner

BLADE LEVELLING APPARATUS AND MOUNTING SYSTEM

FIELD OF INVENTION

The present invention is directed to levelling apparatus, typically as used on tractors and skid-steer vehicles. The present invention has the ability to vary the inclination of the blade portion, about an axis substantially parallel to the direction of travel during use, as well as normal elevation functions.

BACKGROUND DESCRIPTION

The present invention relates to levelers, a device typically attached to tractors, excavators, and skid-steer vehicles for the purpose of levelling and smoothing the ground. It is envisaged however that the present invention may find other uses, and be adapted therefore.

Levelers take many shapes and designs, including those which are merely dragged along the ground. Many, however, have blades (sometimes known as mould boards) for levelling and altering the contour of the ground. In these versions, the height of the blade is typically able to be altered, which allows the user control over grading, levelling and/or sculpting the contour of the ground. Elevation adjustment is sometimes achieved by raising the entire levelling assembly, while others may rely on merely raising and lowering the portion with the blade. One prior art device uses a central hydraulic actuator to raise and lower the blade portion, which is connected to the main body portion with two dual parallel arm linkages. A wheeled carriage extending from the main body portion helps keep the main body portion at a constant height relative to the ground.

For agricultural applications, generally the contour of the land needs merely to be smoothed. However, levelers have found use in construction sites where they are commonly used to level large areas for foundations, particularly concrete foundations. Here the levelling needs to be precisely, and truly horizontal. Achieving this requires operator skill, and patience. Wheeled versions, such as described above, tend to be most popular as merely raising and lowering the blade (as opposed to the entire leveler assembly) is quicker and more precise, enabling quick responses. When coupled with a laser levelling system, adjusting only the blade elevation allows the operator to work much more quickly.

In many instances, not only must the blade elevation be altered but so too must its inclination relative to the tractor/skid steer to ensure that it is always at true horizontal. If the tractor unit traverses a slope, a fixed inclination blade will level the ground at the same inclination as the tractor unit is. This makes levelling mounds and slopes to the true horizontal extremely difficult.

To address this the prior art uses leveler attachment arrangements (typically the ubiquitous Quick-Hitch) which include an arrangement for varying the inclination of the attachment. These rotational arrangements are expensive, and also add considerable weight to the load carried by the tractor unit. They are also limited in the degree of precision with respect to inclination to a particular angle, and relatively slow to adjust. This slows any levelling operation.

Accordingly, the inventor has identified a need for a levelling unit, which can address the above issues, and at least provide a blade portion able to be adjusted in elevation, and inclination (about a rotational axis substantially the same as the direction of travel), and which can be attached to standard connections such as the Quick Hitch, while avoiding the use of additional rotational assemblies.

Ideally also, it would allow a degree of precision making it suitable for use in construction sites, and particularly for foundations. Ideally also, it would speed the work of the user in levelling ground of different inclinations and contours.

Further, it would be desirable to have an adjustable blade device attachable to an excavator, whose arms do not provide for rotation of a blade about an axis perpendicular to the general plane of the blade. Attempting to use a standard tilt adjustable hitch as well as the levelling assembly tends to add too much weight to the end of the excavator arm, and limits its usefulness—especially on smaller excavators able to operate in tight confines. Hence the use of blades on excavators, while desirable and useful, has been hindered and limited.

It would therefore be desirable and useful to provide a potential solution allowing levelling assemblies to be used on excavators.

It would also be useful to provide an improved mounting system which could allow attachment to a levelling assembly to the existing blade or bucket of a vehicle.

It is an object of the present invention to address at least some of the above problems.

At the very least it is an object of the present invention to provide the public with a useful alternative choice.

Aspects of the present invention will be described by way of example only and with reference to the ensuing description.

GENERAL DESCRIPTION OF THE INVENTION

According to one aspect of the present invention there is provided a blade levelling assembly comprising a body mounting portion and a blade body portion;

said two body portions being connected by body connecting linkages which allow a substantially up and down vertical movement of the blade body portion, relative to the body mounting portion, and in which the inclination of a blade associated with the blade body portion remains substantially the same regardless of its vertical position;

the body connecting linkages also allowing a rotational movement of the blade body portion, relative to the body attachment portion, about a rotational axis substantially perpendicular to the general plane of said blade;

said body connecting linkages including linear actuators, there being at least one being present either side of the middle of the blade levelling assembly when viewed in plan;

said body connecting linkages also including at least one pivot-ended stabilising linkage either side of the middle of the levelling assembly when viewed in plan;

and wherein the body connecting linkages assist in maintaining relative movement of the body portions to within the rotational and vertical movements as defined above.

According to another aspect of the present invention there is provided a blade levelling assembly, substantially as described above, in which the up and down vertical movement of the blade body portion, relative to the body mounting portion, is substantially a translational movement within a vertical translational plane.

According to another aspect of the present invention there is provided a blade levelling assembly, substantially as described above, in which there are provided a set of two body connecting linkages, comprising linear actuators, either side of the middle of the blade levelling assembly when viewed in plan.

According to another aspect of the present invention there is provided a blade levelling assembly, substantially as described above, in which the connection point of the linear actuators of each set to the body mounting portion are vertically displaced relative to each other when the blade levelling assembly is viewed from the side.

According to another aspect of the present invention there is provided a blade levelling assembly, substantially as described above, in which the connection point of the linear actuators of each set to the blade mounting portion are vertically displaced relative to each other when the blade levelling assembly is viewed from the side.

According to another aspect of the present invention there is provided a blade levelling assembly, substantially as described above, in which a pivot-ended stabilising linkage extends diagonally between the two body portions when the blade levelling assembly is viewed in plan.

According to another aspect of the present invention there is provided a blade levelling assembly, substantially as described above, in which pivot-ended stabilising linkages extending either side of the middle of the blade levelling assembly when viewed in plan, connect to the blade body portion at a point near its middle when viewed in plan.

According to another aspect of the present invention there is provided a blade levelling assembly, substantially as described above, wherein a pivot-ended stabilising linkage includes a ball joint at least one end.

According to another aspect of the present invention there is provided a blade levelling assembly, substantially as described above, in which the ball joint includes a spherical resilient bush.

According to another aspect of the present invention there is provided a blade levelling assembly, substantially as described above, in which, when viewed in plan, there is at least one pivot-ended stabilising linkage extending substantially perpendicular to the aforesaid permitted plane of relative movement of the blade portion, and located at a position outwardly of the middle of the blade levelling assembly when viewed in plan.

According to another aspect of the present invention there is provided a blade levelling assembly, substantially as described above, in which there is a substantially symmetrical distribution of pivot-ended stabilising linkages either side of the middle of the levelling assembly, when viewed in plan.

According to another aspect of the present invention there is provided a blade levelling assembly, substantially as described above, in which a said linear actuator is hydraulically operated.

According to another aspect of the present invention there is provided a blade levelling assembly, substantially as described above, in which the blade body portion includes at least one stabilising wheel.

According to another aspect of the present invention there is provided a blade levelling assembly, substantially as described above, in which a said stabilising wheel is alternatable between operational and non-operational configurations.

According to another aspect of the present invention there is provided a blade levelling assembly, substantially as described above, in which the body mounting portion is attachable to a vehicle.

According to another aspect of the present invention there is provided a blade levelling assembly, substantially as described above, in which the vehicle is a skid-steer vehicle, an excavator, or a tracked vehicle.

According to another aspect of the present invention there is provided a blade levelling assembly, substantially as described above, in which the body mounting portion attaches by a quick hitch mounting system.

According to another aspect of the present invention there is provided a blade levelling assembly, substantially as described above, in which the body mounting portion attaches to an existing blade mounted on said vehicle.

According to another aspect of the present invention there is provided a blade levelling assembly, substantially as described above, which includes at least one top hook assembly and one bottom hook assembly, for hooking over the top and bottom respectively of an existing blade on a vehicle.

According to another aspect of the present invention there is provided a blade levelling assembly, substantially as described above, in which either or both of the top and bottom hook assemblies contain more than one hook element for hooking over the top or bottom respectively of an existing blade on a vehicle.

According to another aspect of the present invention there is provided a blade levelling assembly, substantially as described above, in which either or both the top and bottom hook assemblies can be tightened for drawing the blade levelling assembly tightly against a said existing blade on a vehicle for mounting thereto, and can be released or relaxed for dismounting therefrom.

According to another aspect of the present invention there is provided a blade levelling assembly, substantially as described above, in which at least one of said hook assemblies affixes to a point of the blade body portion of the blade levelling assembly.

According to another aspect of the present invention there is provided a blade levelling assembly, substantially as described above, when affixed to a vehicle.

According to another aspect of the present invention there is provided a levelling assembly, substantially as described above, when used for ground levelling operations.

According to a further of the present invention there is provided a levelling assembly comprising a body attachment portion and a blade body portion;

the two body portions being connected by body connecting linkages which allow a substantially translational movement of the blade body portion, substantially within a translational plane, relative to the blade body portion;

said body connecting linkages including linear actuators, there being at least one being present either side of the middle of the levelling assembly when viewed in plan;

and wherein the body connecting linkages assist in maintaining relative movement of the body portions to as described above, and which includes a stabilising wheel arrangement on an arm arrangement extending from the body attachment portion.

According to another aspect of the present invention there is provided a levelling assembly, substantially as described in the preceding paragraph, in which the arm arrangement has a pivotable connection allowing the portion on which the stabilising wheel arrangement to pivot upwardly so the stabilising wheel arrangement clears the ground.

According to another aspect of the present invention there is provided a levelling assembly, substantially as described in the preceding two paragraphs, in which the arm arrangement has a pivotable connection allowing the portion on which the stabilising wheel arrangement to pivot upwardly so the stabilising wheel arrangement is positionable substantially over the blade portion.

According to a further aspect of the present invention there is levelling assembly, substantially as described above, which includes an excavator attachment means.

According to a further aspect of the present invention there is levelling assembly, substantially as described above, which includes an upwardly extending mount portion from the body attachment portion, and an excavator quick hitch adaptor connected thereto.

According to a further aspect of the present invention there is levelling assembly, substantially as described above, in which the excavator quick hitch adaptor is pivotably connected to the upwardly extending mount portion.

A preferred use of the present invention is for use in levelling operations. A typical example is a building site which must be leveled, often to true horizontal. Prior to levelling there is like to be mounds, ridges, dips, and various other features in the terrain which must be reformed to being flat and level (typically horizontal, but the final level could be an inclined plane). Prior to levelling, a vehicle travelling across the ground is likely to suffer from a degree of pitch and roll. If the blade is fixed relative to the vehicle then it will be a time consuming and difficult challenge to level the ground. Most skid steer vehicles and the like to which a blade is mounted are able to lift the blade up and down. However rotating them about an axis (such as the direction of travel) to compensate for roll of the vehicle, is only possible when expensive or heavy tilting hitch assemblies are employed to mount the blade to the vehicle—not always a desirable or feasible option, particularly for vehicles such as excavators.

Preferred embodiments of the present invention comprise, in simple form, a body mounting portion—which can be affixed to (or employed as part of) a vehicle—and a blade body portion which includes or can have attached a blade for operations such as ground levelling. A linkage assembly, in preferred embodiments, has a geometry allowing restricted movements of the blade body portion relative to the body mounting portion—which effectively means, when attached to a vehicle, restricted movement of the blade relative to the vehicle.

The linkage assembly, as will be described more completely herein, typically comprises a combination of stabilising linkages (typically of fixed length) and linear actuators, which can be lengthened or shortened to effect relative movement of the blade body portion with respect to the body mounting portion. In preferred embodiments these linear actuators are hydraulically operated, but need not be in all embodiments.

The geometry allows for the blade body portion to undergo several movements relative to the body mounting portion (and hence vehicle). The first is an up and down movement. Here the general plane of the blade can remain substantially the same during the up and down movement, such that the movement is virtually an up and down translational movement—i.e. the general plane of the blade remains substantially within a translational plane. This movement allows the elevation of the bottom of the blade to be altered as the vehicle travels over mounds in the ground. Use may be made of a laser guidance control system to help maintain the bottom of the blade at a particular elevation relative to a ground reference point.

Here the lengthening and shortening of the linear actuators control the up and down movement, while stabilising linkages help prevent rotation of the blade plane about a vertical axis.

Another permitted operation is rotation of the blade body portion about a rotational axis substantially perpendicular to a translational plane such as described above. In other words, typically in preferred embodiments about an axis representing the direction of forward travel of the vehicle. This is the equivalent of that typically allowed for by tilting hitch mounts, except this time the linkage geometry of the levelling device provides this feature at much lesser cost and weight.

Preferred embodiments ideally have a pair of stabilising arms, ideally with ball joint connections at at least one end of each, to also help restrict rotational movement of the general plane of the blade to substantially within a said translational plane as mentioned above—i.e. they help prevent rotation of the blade or blade body portion about a vertical axis as other movements are effected.

Both the translational (i.e. up/down) and rotational movements (about a forward facing axis) mentioned above may be sequentially or simultaneously effected. Specialised embodiments may also allow for some rotation of the blade body portion, or the blade itself, about a transverse (relative to the direction of travel) axis as well.

The aforesaid movements will allow, in the case of a blade levelling assembly mounted to a vehicle performing a ground levelling operation, for the operator to maintain the bottom edge of the blade at a fixed level relative to a reference (within the limits of the capacity of the equipment to compensate for extremes in the level of the ground). With the use of a laser reference level guidance system to control the linear actuators, the blade body portion (and hence blade) can be automatically maintained in an optimal elevation and tilt inclination to effect levelling (relative to a reference plane which need not be horizontal), ultimately within very tight tolerances.

The arrangement is also useful for attachment to excavator mounts, though a different mounting system may need to be adopted body mounting portion. Excavator mounting systems do not typically allow for any rotational (about a forward axis) adjustment of an attached blade—the levelling assembly of the present invention includes this feature, thereby making it possible for excavators to more effectively perform ground levelling operations.

In more advanced embodiments there is provided a stabilising wheel arrangement, typically forwardly of the blade. This wheel arrangement may be alternately between operational (contacting the ground) and non-operational positions. In a preferred arrangement the arm arrangement includes a pivoting connection allowing the end portion (with the stabilising wheel arrangement) to pivot upwardly such that the wheels clear the ground. Preferably the stabilising wheel arm of this embodiment pivots to a perpendicular position or backwardly of perpendicular, and more preferably so that the end arm portion and wheel arrangement are positioned behind the pivotable connection. This arrangement, while simple in hindsight, addresses a few significant issues and provide several realizable advantages.

For instance, one of the problems encountered during use is when an operator comes up to a boundary edge and the stabilising wheel arrangement encounters the boundary (e.g. a fence, wall, geographical feature) before the blade does. This means closest the blade can get may be around 1600-1800 mm from the boundary. By implementing the folding arm arrangement the length may typically be reduced by around 1200 mm depending on the specific design. This is much better for work in close confines. Also, as not all applications of the invention may require the use of the stabilising arm and thus the user has the option of either using the stabilising arm or having it raised, effectively converting the embodiment into a dual purpose utility device.

Additionally, for the transport of manufactured devices (e.g. on a truck or a container), space—particularly length—is critical. The ability to fold, as shown in the following illustrations, can reduce the length by around 40% which significantly decreases transport costs for multiple units when exporting or transporting cross-country.

To further improve the versatility of the present invention, a further specialised embodiment of the present invention allows the levelling assembly to attach directly to the existing blade of a vehicle—useful where a vehicle may not have a blade able to be quickly removed, or at all.

Preferred implementations of these embodiments have at least one first hook like feature for engaging the top edge of an existing vehicle blade, and at least one second hook like feature for engaging the bottom edge of said existing vehicle blade. At least one of said first and second hook like features will include tightening means (typically on a link to the levelling assembly) which allows the levelling assembly to be drawn tight against said existing vehicle blade—and subsequently relaxed for release from the existing vehicle blade. This represent a quick and effective system for securing levelling assembly to an existing blade.

Hence, in summary, ideally the geometry of the linkages between the body portions allow for the rotational angle of the blade portion (and hence blade) to be altered relative to the attachment portion, as well as its elevation relative thereto. In this case we are using the attachment portion as our reference point. In reality the blade edge itself will be come the fixed point, relative to a reference point of true ground level and true horizontal. Hence the blade will be maintained in the same position (as far as is possible) despite changes in the pitch or roll of the vehicle to which the levelling assembly is attached.

To allow for the relatively independent control of each end of the blade portion, the primary stabilising linkages will have pivoting ends—preferably a ball joint—to accommodate the geometry changes as the actuators are extended or contracted. In this case the geometry is chosen also to provide lateral stability of the two body portions, as well as substantially maintaining their distance of separation (major differences here as the blade changes position can affect the outcome for a device mounted on a moving vehicle).

The nature and operation of the embodiment described above will be better described with reference to the drawings.

DESCRIPTION OF PREFERRED EMBODIMENT

Figure 3A:
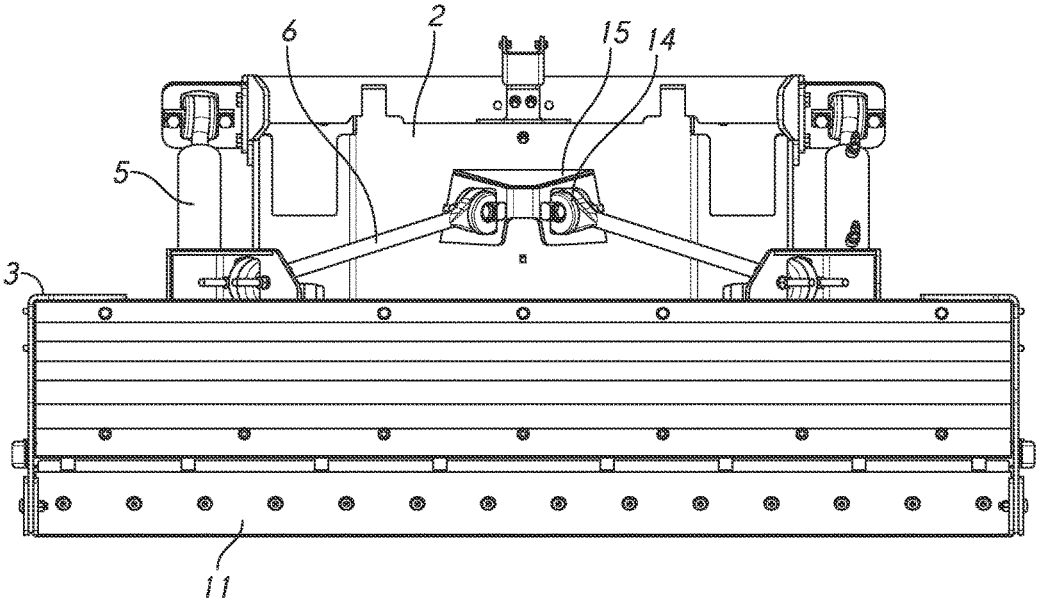
Figure 3B:
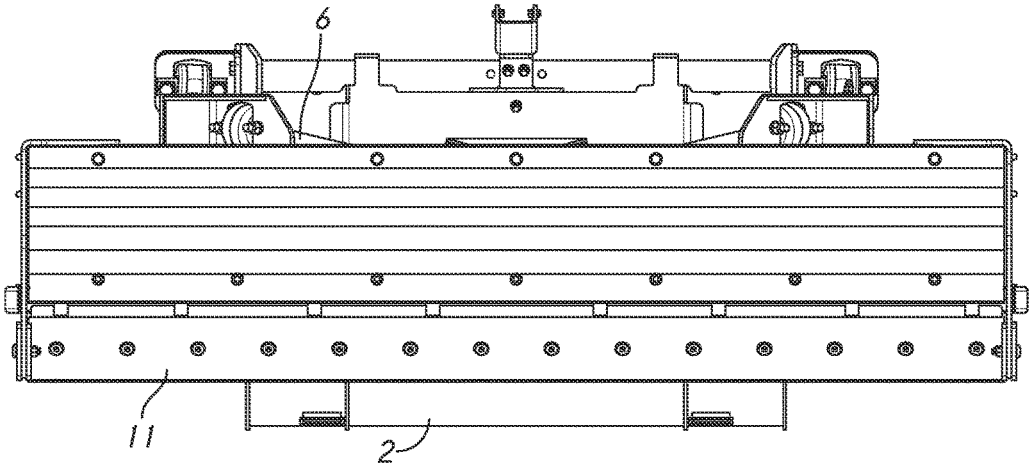
Figure 3C:
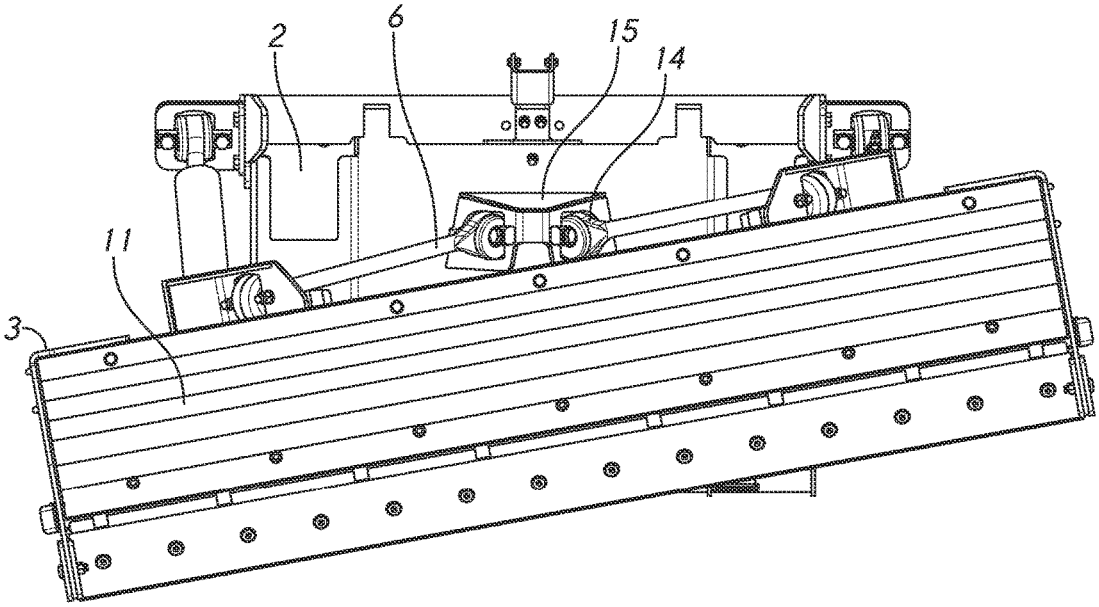

With reference to the drawings, and by way of example only, there is provided a levelling assembly (generally indicated by arrow 1) comprising a body attachment portion (generally indicated by arrow 2) and a blade body portion (generally indicated by arrow 3);

the two body portions (2, 3) being connected by body connecting linkages (5-7) which allow a substantially translational movement of the blade body portion (3), substantially parallel and relative to the blade body portion (2)—see for instance FIGS. 3*a* and 3*b*;

the body connecting linkages (5-7) also allowing a rotational movement of the blade body portion (3), relative to the body attachment portion (2), about a rotational axis substantially in the direction of forward travel (9) of the assembly (1)—see for instance FIG. 3*c;* said body connecting linkages including linear actuators (5*a, b*), there being at least one linear actuator (5) being present either side of the middle (10) of the levelling assembly (1) when viewed in plan;

said body connecting linkages (5-7) also including at least one pivot-ended stabilising linkage (6-7) either side of the middle (10) of the levelling assembly (1) when viewed in plan;

and wherein the body connecting linkages (5-7) assist in maintaining relative movement of the body portions to as described above.

The body attachment portion (2) includes a quick-hitch arrangement (4) such as commonly used on skid-steer tractors.

Figure 1:
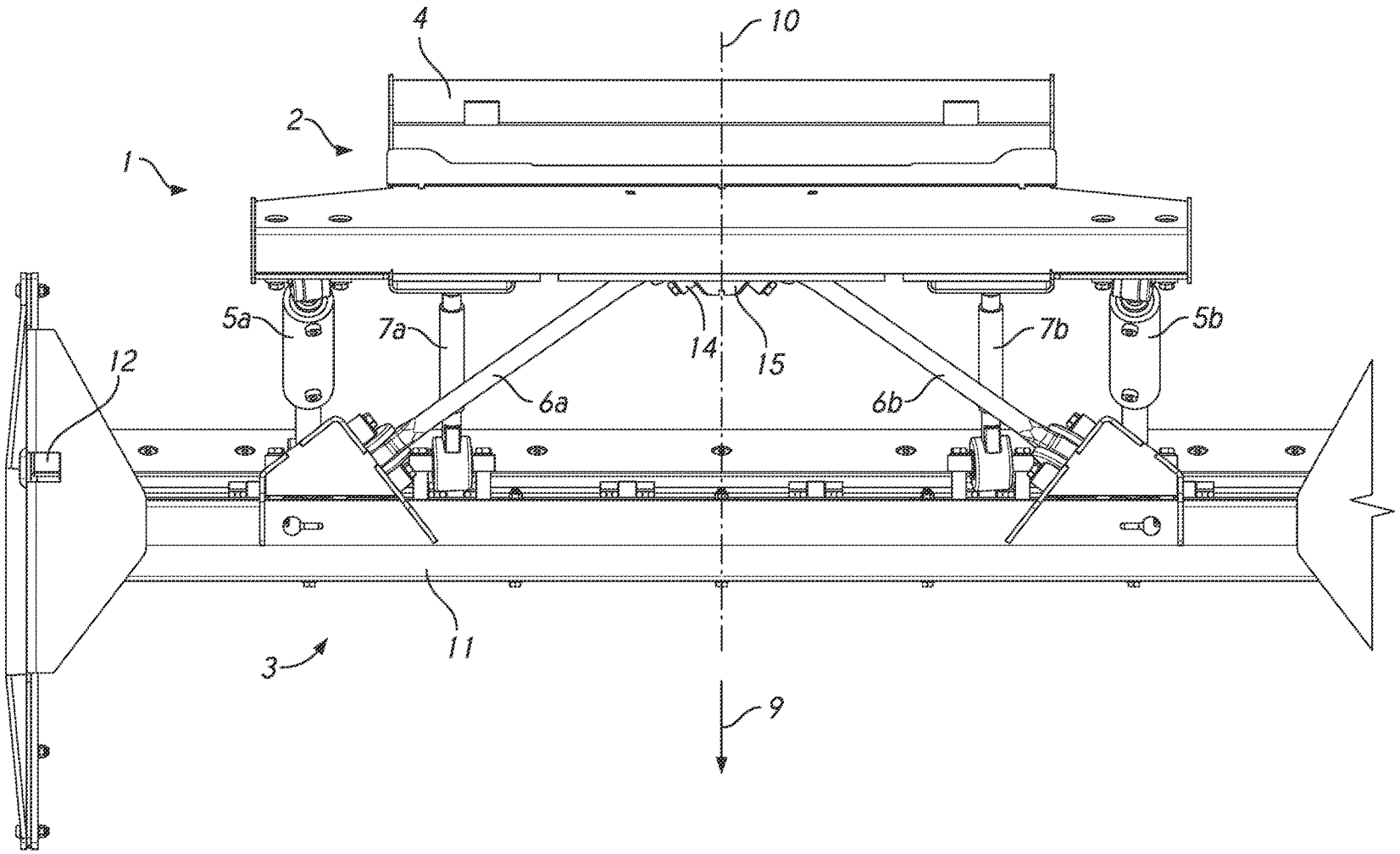
FIG. 1 is a partial plan view of one preferred embodiment of the present invention.
Figure 2:
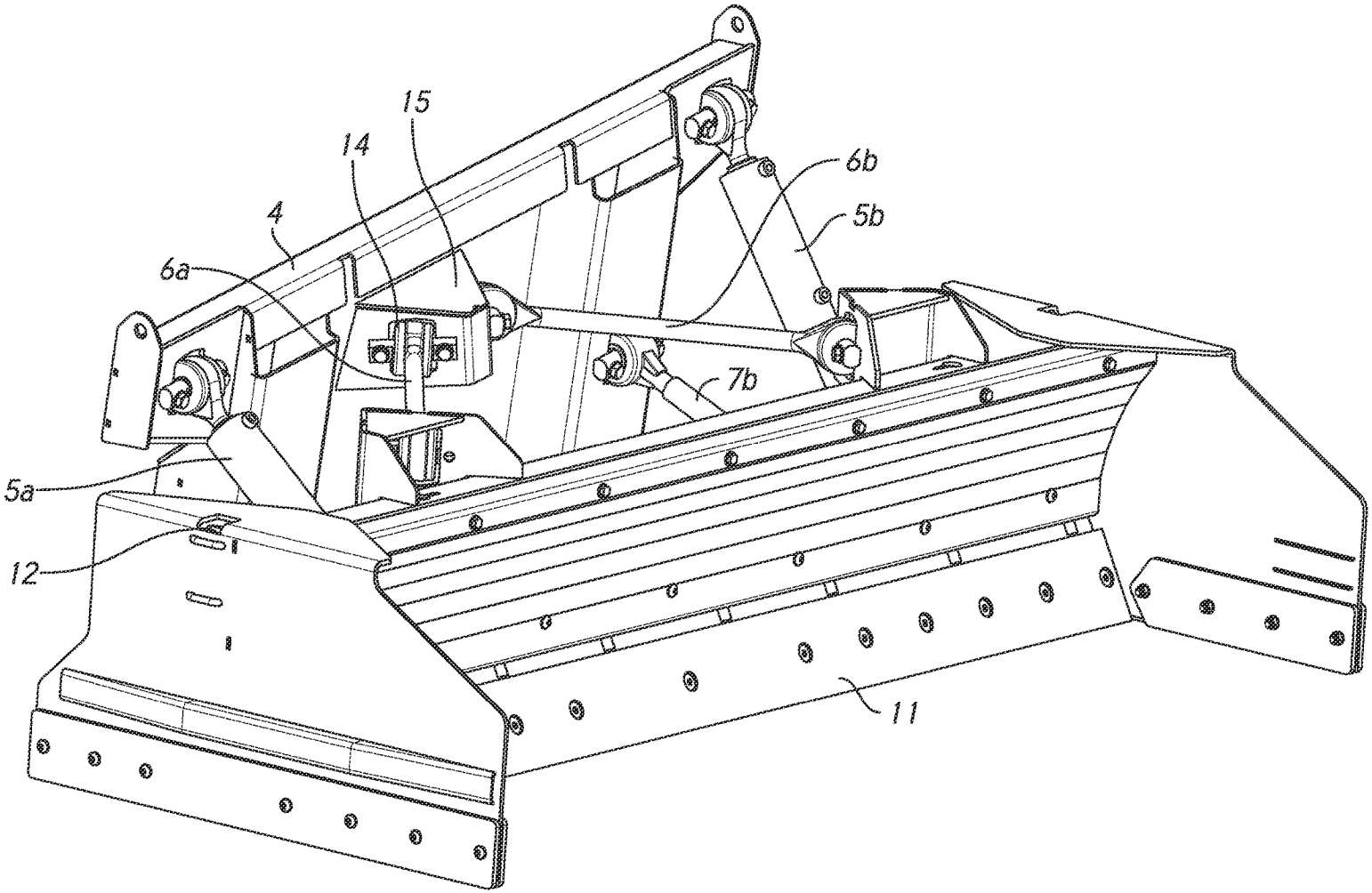
FIG. 2 is a perspective view of the embodiment of FIG. 1 in an alternative configuration, FIG. 3 are front views of the embodiment of FIG. 1 with the blade in lowered, raised, and inclined (about a forward axis) respectively.

In the illustrated embodiment (1) there are two hydraulically controlled upper linear actuators (5*a, b*) which can be independently controlled to alter the relationship of each end of the blade portion (3) relative to the body attachment portion (2). This is best illustrated in FIG. 2, where right hand actuator (5*b*) is contracted relative to left hand actuator (5*a*) to adopt a configuration such as shown in FIG. 3*c*. While lower linkages (7) may comprise connecting arms, these may also comprise hydraulically controlled lower linear actuators which work in cooperation with actuators (5) to allow the blade body portion to adopt the configurations shown in FIG. 3, and combinations thereof. This arrangement can also allow for alteration of the inclination of the blade (11) about a transverse axis, under the control of the operator.

The stabilising linkages, pivot-ended linkages (6*a, b*) (7*a, b*) have ball joint ends where they attach to at least one of the body portions (2, 3) which is necessary to allow for the permitted relative movements of the body portions (2, 3). In the present invention a spherical bush is used in the joints—this joint (14) can be clearly seen in the stabilising arms (6) where they (in this embodiment) attach to a central mounting point (15) on the body mounting portion (2).

The geometry of the remaining connecting linkages (stabilising arms (6-7)) assist in maintaining the relationship between the two body portions (2, 3) as movement occurs (such as shown in FIG. 3). In this arrangement the distance of separation between the body portions (2, 3) remains substantially the same, as does their relative forward/rearward inclinations (i.e. inclination being rotation about a transverse axis) relative to each other (though some flexibility is allowed here in the design of the geometry in various embodiments).

The primary permitted relative movements between the body portions (2, 3) are, when viewed from the front and wherein the body attachment portion (2) is considered fixed in position, relative upward and downward movement of the blade body portion (3) relative to the body attachment portion (2), as well as allowing relative upward and downward movement of each end of the blade body portion (3) relative to the body attachment portion (2)—allowing also for inclination of the blade portion (3) (relative to the body attachment portion (2)), such as shown in FIG. 2.

Accordingly there is provided a precise alteration of the elevation and rotational inclination of the blade relative to the quick hitch (4) (which follows the roll inclination of the vehicle in response to ground contours) without the need for heavy and expensive quick hitch rotational attachments. The arrangement of the illustrated embodiment theoretically provides for faster (quick response movements are important for a moving vehicle) changes to the elevation and rotational inclination of the blade, as well as being much more precise.

The actuators can also be coupled to a laser levelling control system (sensors or emitters can be mounted on arms (not shown) which fix at positions (12) on the blade portion (3)) so that the blade (11) is maintained at true ground elevation and the horizontal, regardless of any pitching and rolling movements of the vehicle to which it (1) is attached. As mentioned above, the quicker responsiveness of the present embodiment also allows the vehicle to travel faster.

Preliminary trials by the inventor, have indicated that the present invention when used with a laser levelling system can level ground to a much higher degree of precision (±3 mm compared to ±10 mm) approximately 12 times faster than when using a similar arrangement with a prior art device. This represents a very significant advance in the art in terms of productivity and precision. Accordingly this also opens the present invention up to other applications where a tool on a moving vehicle needs to be maintained at a precise inclination and elevation.

Figure 4:
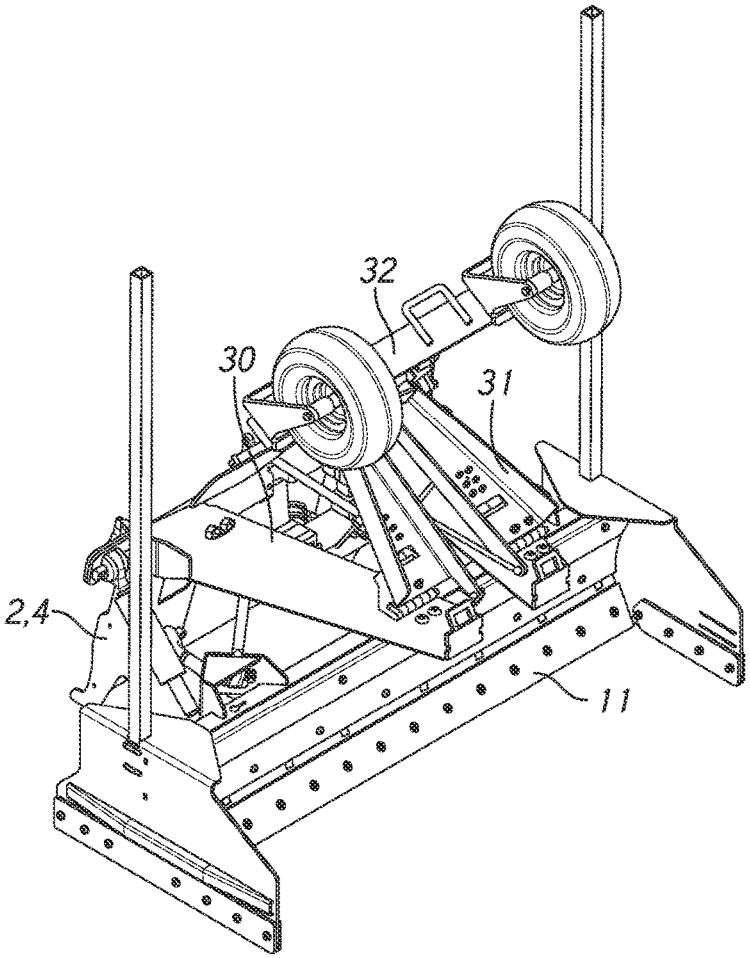
FIG. 4 is a perspective view of an alternative embodiment of the present invention in a folded configuration.
Figure 5:
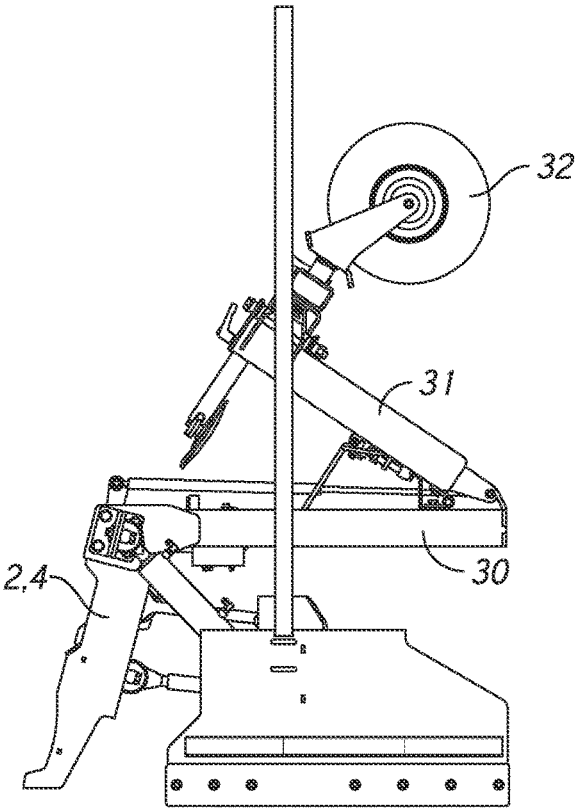
FIG. 5 is a side diagrammatic view of the embodiment of FIG. 3.

In FIGS. 4 and 5 we see a folding embodiment of the present invention, where a provided stabilising arm assembly (30) has a folding end portion (31) on which a ground contacting stabilising wheel arrangement (32) is mounted.

In FIG. 5 the reduced front to rear length of the apparatus is evident, as are the potential transport benefits. Similarly, the closer proximity of the blade (11) to the front of the apparatus, for close work, can be gauged.

Figure 7:
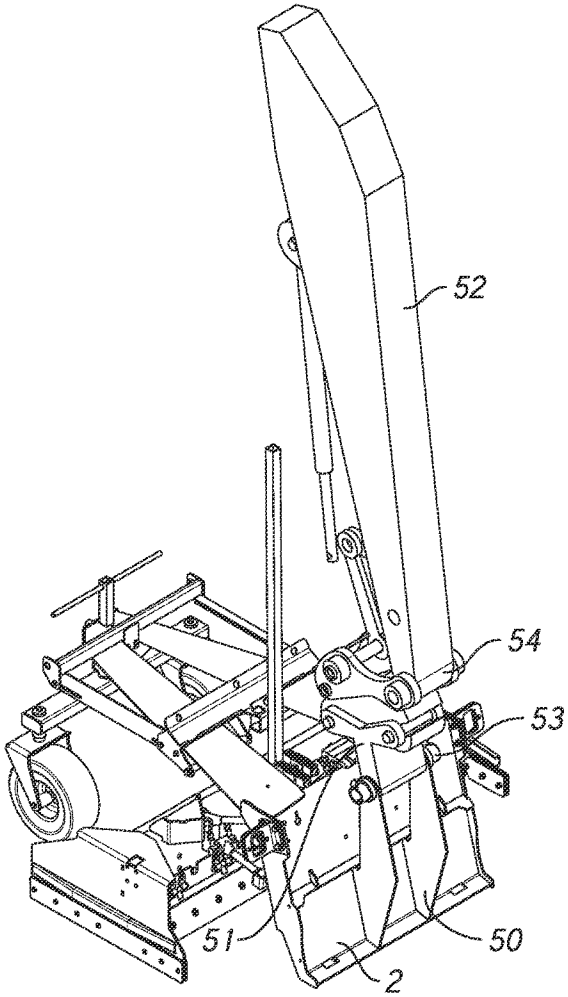
FIG. 7 is a perspective view of the embodiment in FIG. 6.
Figure 6:
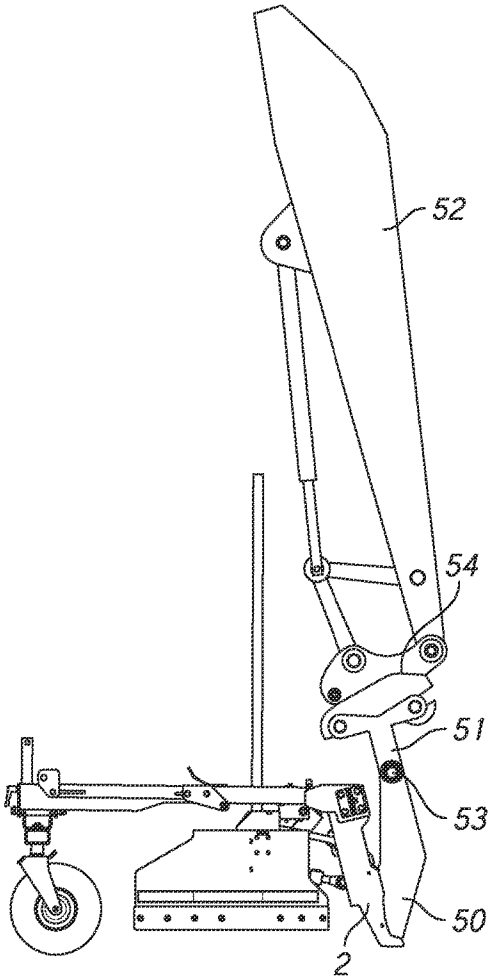
FIG. 6 is a side diagrammatic view of FIG. 4 in an extended configuration.

In FIGS. 6 and 7 we see a further embodiment suitable for attachment to an excavator. Rather than a quick hitch (4) we have an arm arrangement (50) to which is pivotably attached (53) a T-pin (51) comprising a quick hitch adaptor (which may be of different quick connect configurations) to which the quick hitch adaptor (54) of an excavator's (not shown) dipper arm (52) may be attached. This arrangement makes the levelling assembly available for use with excavators, a new and novel arrangement which significantly improves the versatility of both excavators and levelling devices.

Figure 8:
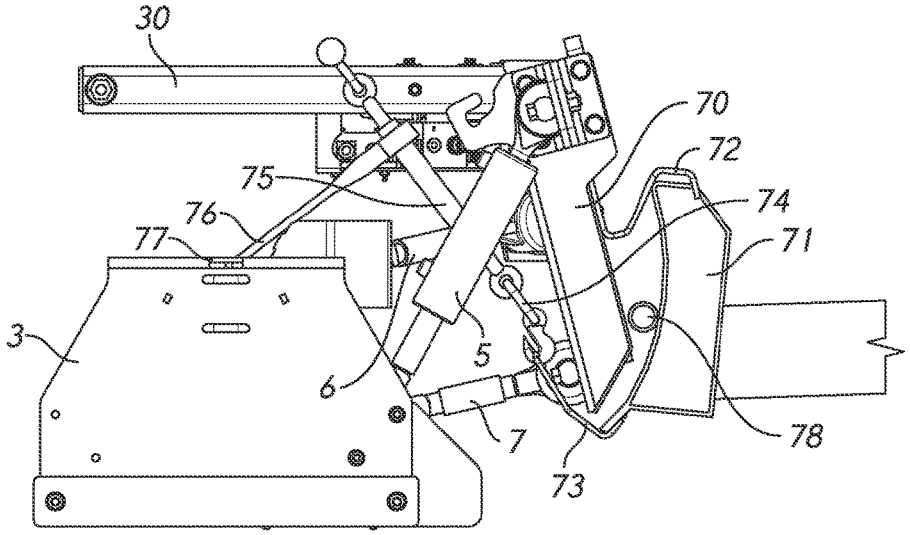
FIG. 8 is a side diagrammatic view of a further embodiment of the present invention attached to the existing blade of a vehicle.
Figure 9:
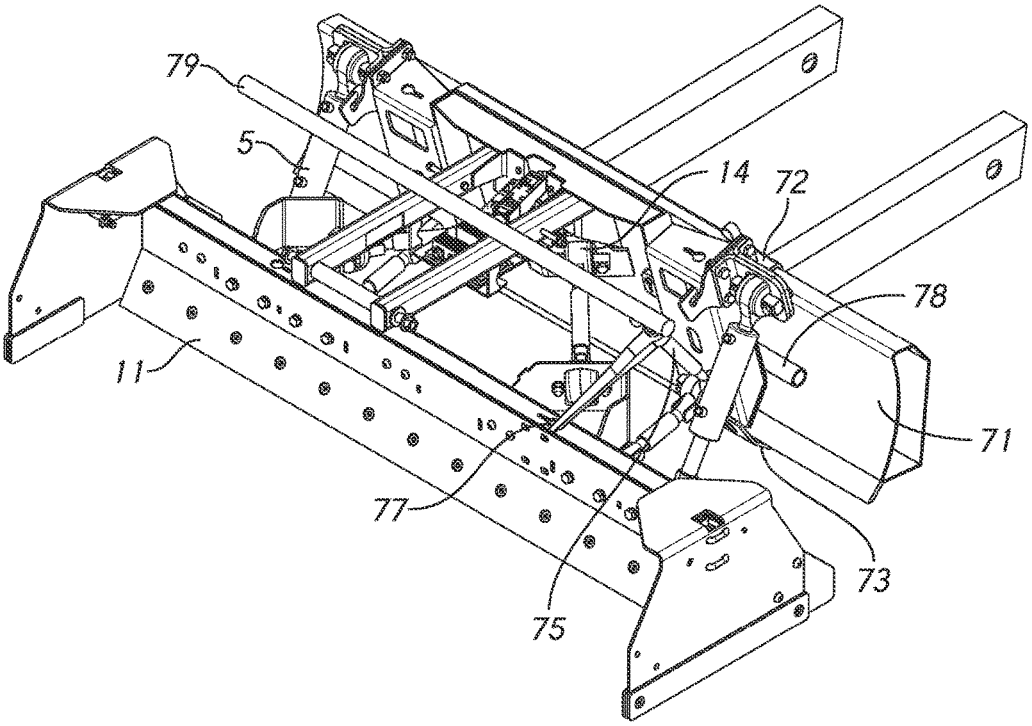
FIG. 9 is a perspective view of the embodiment of FIG. 8.

In FIGS. 8 and 9 we see an alternative mounting system to the ubiquitous quick hitch (4), the body mounting portion (70) attaching to the existing blade (71) of a vehicle (not shown for simplicity).

Here at least one upper hook portion (72) affixed to the body mounting portion (70) hooks over the top of the existing blade (71). A contacting bar (78) may be provided on the body mounting portion (70) to help accommodate the different curves of blades and reduce possible damage to the blade (71).

A lower hook portion (73) connected by a flexible linkage (74) to an adjustable linking element (75), in turn connected to an element (79) associated with the body mounting portion (70), helps secure the levelling assembly (1) to the existing blade (71) as the adjustable element(s) (75) are tightened. The adjustable element (75) may simply be a turnbuckle in a preferred element, and may be provided with an arm (76) to help tighten the turnbuckle, and provide additional stabilisation when the distal end of the arm (76) is connected to a point (77) on the blade body portion (3) after tightening.

Aspects of the present invention have been described by way of example only and it should be appreciated that modifications and additions may be made thereto without departing from the spirit or scope of the present invention as described herein.

It should also be understood that the term "comprise" where used herein is not to be considered to be used in a limiting sense. Accordingly, 'comprise' does not represent nor define an exclusive set of items, but includes the possibility of other components and items being added to the list.

This specification is also based on the understanding of the inventor regarding the prior art. The prior art description should not be regarded as being authoritative disclosure on the true state of the prior art but rather as referencing considerations brought to the mind and attention of the inventor when developing this invention.

The invention claimed is:

1. A blade levelling assembly for mounting to a vehicle, the blade levelling assembly comprising:

a body mounting portion; and a blade body portion, said body mounting portion and the blade body portion being connected by first and second sets of connecting linkages, the first set of connecting linkages comprising two fixed length stabilizing arms, each of the fixed length stabilizing arms of the first set of connecting linkages being (i) pivotably connected at one end to a fixed point on the body mounting portion, the fixed point being at or near the middle of the body mounting portion, and (ii) extending diagonally outwardly, when viewed in plan, from the fixed point on the body mounting portion, to pivotally connect to the blade body portion at a point outwardly of the middle of the blade body portion, the second set of connecting linkages comprising two fixed length stabilizing arms, each of the fixed length stabilizing arms of the second set of connecting linkages being (i) pivotably connected at one end to the body mounting portion at a first point outwardly and on either side of the middle of the body mounting portion when viewed in plan, and (ii) pivotally connected at another end to to the blade body portion at a point outwardly and on either side of the middle of the blade body portion, said first and second sets of connecting linkages being vertically separated from each other when said blade levelling assembly is viewed from the side, when said blade levelling assembly is viewed from the side, said points where said stabilizing arms of said first set of connecting linkages connect to said body mounting portion being vertically separated from the points where said stabilizing arms of said second set of connecting linkages connect to said body mounting portion, when said blade levelling assembly is viewed from the side, said points where said stabilizing arms of said first set of connecting linkages connect to said blade body portion being vertically separated from said points where said stabilizing arms of said second set of connecting linkages connect to said blade body portion, said first and second sets of connecting linkages interacting to allow relative movement of the blade body portion relative to the body mounting portion, said relative movement comprising:

(i) vertical translational movement of said blade body portion relative to said body mounting portion, and (ii) rotational movement of said blade body portion, relative to said body mounting portion, about an axis normal to a general plane of the blade body portion, and wherein a forward inclination of said blade body portion relative to said body mounting portion remains substantially unaltered during said relative movements.

2. The blade levelling assembly as claimed in claim 1, wherein the first and second sets of connecting linkages comprise linear actuators, one end of each of the linear actuators being connected to a first connection point outwardly and to either side of the middle of said blade levelling assembly when viewed in plan, another end of each of the linear actuators being connected to a connection point outwardly and on either side of the middle of said blade mounting assembly.

3. The blade levelling assembly as claimed in claim 2, wherein the first connection point of one of the linear actuators to the body mounting portion is vertically displaced relative to the second connection of the linear actuator to the blade body portion when the blade levelling assembly is viewed from the side.

4. The blade levelling assembly as claimed in claim 1, wherein at least one connection between the body mounting portion or the blade body portion and the first and second connecting linkages is a pivotable connection comprising a ball joint.

5. The blade levelling assembly as claimed in claim 4, wherein the ball joint includes a spherical resilient bush.

6. The blade levelling assembly as claimed claim 1, wherein there is a substantially symmetrical distribution of stabilizing arms from the first and second sets of connecting linkages, when viewed in plan.

7. The blade levelling assembly as claimed in claim 2, wherein said linear actuator is hydraulically operated.

8. The blade levelling assembly as claimed in claim 1, wherein the blade body portion includes at least one stabilizing wheel.

9. The blade levelling assembly as claimed in claim 8, wherein said stabilizing wheel is alternable between operational and non-operational configurations.

10. The blade levelling assembly as claimed in claim 1, wherein the body mounting portion is attachable to the vehicle.

11. The blade levelling assembly as claimed in claim 10, wherein the body mounting portion attaches to an existing blade mounted on said vehicle.

12. The blade levelling assembly as claimed in claim 11, further comprising at least one top hook assembly and one bottom hook assembly, the at least one top hook assembly and the one bottom hook assembly being configured to hook over the top and bottom respectively of an existing blade on a vehicle.

13. The blade levelling assembly as claimed in claim 12, wherein at least one of said hook assemblies affixes to a point of the blade body portion of the blade levelling assembly.

14. The blade levelling assembly as claimed in claim 1, wherein the blade levelling assembly is configured to be affixed to a vehicle.

* * * * *